US005494243A

United States Patent [19]

Kuhn

[11] Patent Number: 5,494,243

[45] Date of Patent: Feb. 27, 1996

[54] RAILROAD SWITCH STAND WITH FOOT OPERATED HANDLE LATCH

[75] Inventor: Stephen R. Kuhn, Richton Park, Ill.

[73] Assignee: ABC Rail Products Corporation, Chicago, Ill.

[21] Appl. No.: 248,668

[22] Filed: May 25, 1994

[51] Int. Cl.[6] ..... F01B 7/00

[52] U.S. Cl. ..... 246/401; 246/393; 246/411

[58] Field of Search ..... 246/393, 395, 246/396, 397, 401, 402, 407, 410, 411, 412

[56] References Cited

U.S. PATENT DOCUMENTS

| | | | |
|---|---|---|---|
| 525,678 | 9/1894 | Dedel | 246/400 |
| 858,342 | 6/1907 | Higginbotham | 246/410 |
| 936,819 | 10/1909 | Scott | 246/405 |
| 2,449,239 | 9/1948 | Magnus | 246/411 |

*Primary Examiner*—Robert J. Oberleitner
*Assistant Examiner*—S. Joseph Morano
*Attorney, Agent, or Firm*—Thomas S. Baker, Jr.

[57] ABSTRACT

A railroad switch stand for switching railroad track switch points is provided with a manually-operated crank assembly that is coupled to the switch stand switching input shaft without included lost motion and that has an included yoke with latch bars that function to stop and secure the crank assembly in operating positions that reduce operator risk to excessive back stress and lower spine injury.

5 Claims, 2 Drawing Sheets

RAILROAD SWITCH STAND WITH FOOT OPERATED HANDLE LATCH

FIELD OF THE INVENTION

This invention relates generally to railroad track switching, and particularly concerns a railroad switch stand and component parts for a railroad switch stand which function to obtain a significantly reduced hand-crank range of operating motion.

BACKGROUND OF THE INVENTION

Many manually-operated railroad switch stands offered and utilized in the United States by the rail transportation industry are provided with a hand-crank assembly that is operated throughout a rotational range of approximately 180 degrees. The assembly has an input shaft that requires only about 120 degrees of rotation to achieve a change in switch operating positions, and a so-called "lost motion" torque-transmitting connection between the hub of the crank arm element and the switch stand input shaft element. Such switch stand units also are normally provided with foot latches or similar devices for locating and retaining the switch stand crank assembly element securely in its alternative and approximately 180 degree-separated extreme operating positions.

It is well-known that railroad operating personnel responsible for manual switch stand operation may frequently experience costly serious back injury, generally in the nature of spinal injury and/or excessive muscular stress, in the course of actuating switch stands having the known crank assembly with a lost motion connection configuration. Some improvement in switch stand operator ergonomics has been achieved by a reconfiguration of the handle element normally attached to the crank lever for use by the switch operator. However, it has been discovered that a still further reduction in operator injury may be realized by additionally applying ergonomic principles to a redesign of the manually-operated stand in a manner that essentially eliminates the need for moving the hand-crank arm element through the range of motion that is excess to the switch input shaft rotation requirement.

SUMMARY OF THE INVENTION

The present railroad switch stand invention utilizes an improved manual-force input crank assembly which is joined to the input shaft of a railroad switch stand that normally actuates conventional railroad track switch points through a cooperating connecting-rod interconnection. The improved switch stand crank assembly has a manually-operated crank arm, a novel latch yoke that is securely attached to the crank operating arm, and an adapter hub element or equivalent that couples the crank operating arm and attached latch yoke to the switch stand input shaft in a manner whereby all motion and torquing forces applied to the crank operating arm are transmitted to and cause motion of the switch stand input shaft. The latch yoke is provided with transversely-oriented arms and integral latch bar elements that are positioned to cooperate with diametrically-opposed conventional foot latches provided in the switch stand assembly and that function to limit manually-caused motion of the crank operating arm to a rotational range that corresponds to the range of rotational motion required by the switch stand input shaft, usually about 120 degrees of rotation. The crank operating arm is additionally fitted with an operator handle element, and preferably with a handle having substantial lateral offsets relative to the longitudinal axis of the crank operating arm.

Additional particulars regarding the invention are provided in the drawings and detailed description. Also, additional advantages associated with utilization of the present invention will become apparent during a careful consideration of the further specification materials.

DETAILED DESCRIPTION

Figure 1:
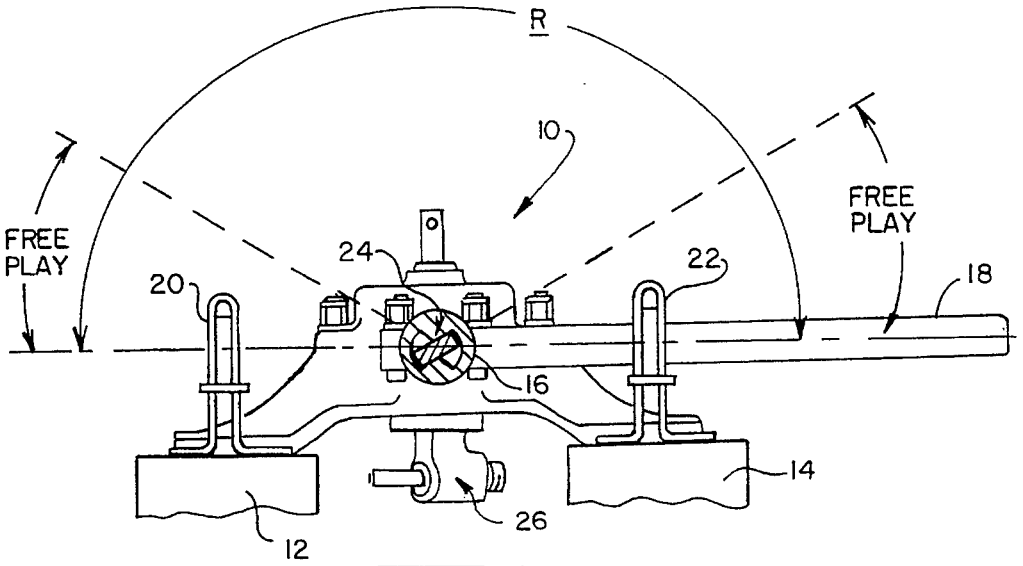
FIG. 1 PRIOR ART
FIG. 1 is a partially-sectioned elevational view of a railroad switch stand installation having a prior art input shaft and operating crank construction.

FIG. 1 illustrates a known type of railroad switch stand (10) mounted on railroad track ties (12 an 14). The switch stand (10) is provided with an input shaft (16), with a manually-operated crank arm/handle (18) , and with diametrically-opposed foot latch assemblies (20 and 22) mounted on ties (12 and 14) respectively. Manual rotation of the arm/handle (18) in a range (R, FIG. 1) of approximately 180 degrees, and from engagement with one latch assembly (20 and 22) to engagement with the other latch assembly (22 and 20), causes, through the functioning of a lost-motion hub (24) attached to the arm/handle (18), rotation of the input shaft (16) of approximately 120 degrees and consequent rotation of a switching crank and switch point connecting rod elements (26) to a new switching position. Thus, as shown in FIG. 1, there is normally provided about 30 degrees of arm/handle free-play at each end of the rotational operating range of the input shaft (16).

Figure 2:
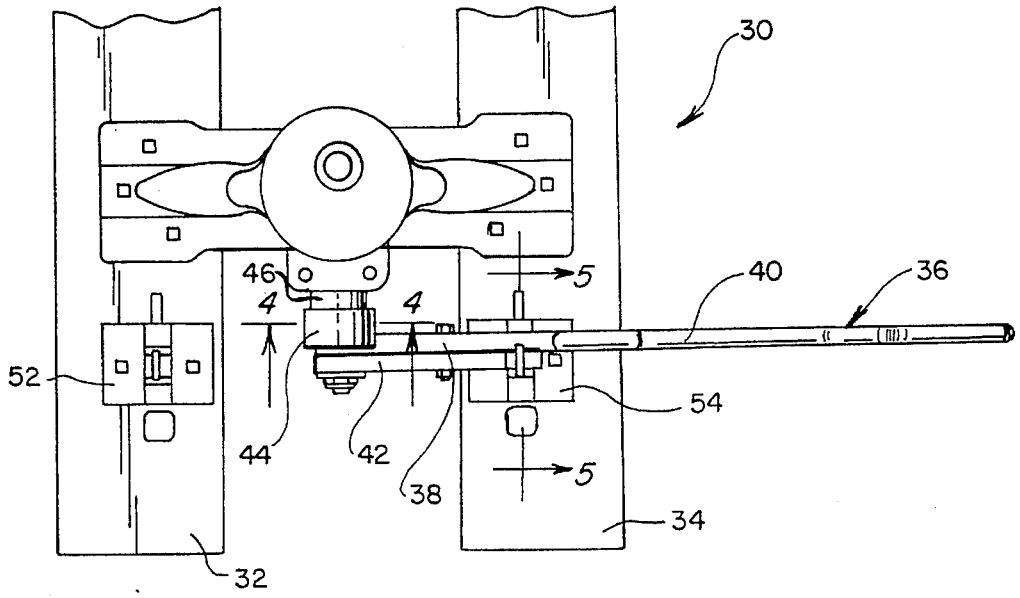
FIG. 2 is a plan view of a railroad switch stand installation incorporating the present invention.

An improved railroad switch stand installation (30) that makes use of the present invention and that substantially reduces the angular movement of crank arm/handle (18) required to drive the switch stand (10) from one operating position to the other operating position is shown in plan in FIG. 2. The installation tie elements (32 and 34) and the installation of diametrically-opposed conventional foot latch devices (52 and 54) remain the same as in the FIG. 1 switch stand installation. However, an improved manually-operated crank assembly (36) is incorporated into the installation (30).

The improved manual crank assembly (36) is comprised of a crank arm (38), a handle (40) attached to the crank arm, a novel latch yoke assembly (42) attached to the crank arm (38), and an adapter hub (44) that functions in part to couple the arm/handle and latch yoke combination to a switch stand input shaft (46). Adapter hub (44) rigidly couples arm/handle and latch yoke combination to input shaft (46) such that all motion imparted to the improved crank assembly in any direction and at any time is likewise imparted to the switch stand input shaft (46) thus eliminating any free play or "lost motion" in installation manual operation. A conventional threaded fastener is utilized to secure the assembly (36) to a reduced-diameter threaded end of the switch stand switching input shaft (46).

The yoke assembly (42) is provided with integral latch bar elements (48 and 50) that are positioned distantly and laterally to either side of the longitudinal axis of the operating arm (38), and that function to engage the conventional foot latches (52 and 54) when the manually-operated crank is positioned in either of its extreme operating positions. Each of the latch bar elements (48 and 50) is positioned so as to form an angle of approximately 30 degrees between the longitudinal axis of the crank arm (38) and a line extending from the adapter hub (44) to one of said latch bar elements (48 and 50). The yoke assembly (42) is secured to the crank arm (38) by a conventional threaded fastener (56) and the operating arm (38) has an end opening (not shown) through which the switch stand input shaft (46) passes.

Figure 3:
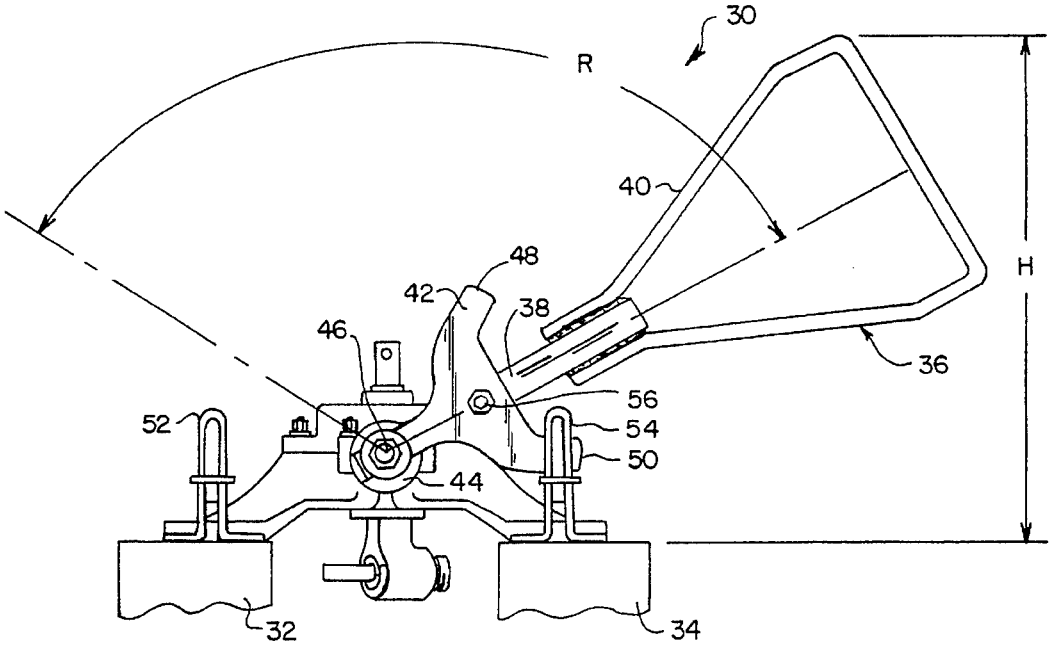
FIG. 3 is an elevational view of the railroad switch stand installation of FIG. 2.

From an operator injury-reduction standpoint it is important to note in FIG. 3, which depicts crank assembly (36) in one of its operating position extremes, that: (1) the crank arm element (38) is significantly elevated in comparison to the position of the FIG. 1 crank arm (18), and (2) the crank handle (40) has an upper, hand-grasped offset that is displaced laterally upwardly relative to the longitudinal axis of the crank arm (38). Each feature contributes to operator injury reduction because of the significantly reduced degree of operator back bending required to accomplish crank assembly rotation. In one actual embodiment of the railroad switch stand (30), the upper extreme of the handle (40) is positioned at a height (H, FIG. 3) approximately 30 inches above the top surface of the track ties (32 and 34) when the switch stand (30) is in either of its extreme operating position. Also, it should be noted that the manual operating range (R, FIG. 3) of the crank assembly (36) is substantially less than the crank assembly manual operating range illustrated in the FIG. 1 prior art railroad switch stand.

Figure 4:
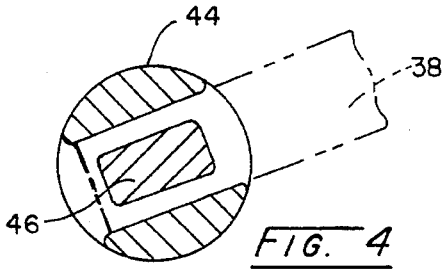
FIG. 4 is a sectional view of the invention adapter hub taken along the line 4—4 of FIG. 2.

FIG. 4 is a sectional view of the adapter element (44) which functions to rigidly couple the crank assembly (36) to the switch stand input shaft (46). At the section 4—4 line of FIG. 2, the switch stand input shaft (46) preferably has a noncircular cross-section such as the rectangular cross-section that is illustrated in FIG. 4. Although the drawings illustrate a crank assembly construction in which the adapter element (44) is a separate component part, it is recognized that the functional features of that element may be equivalently made integral with the crank arm (38) thus eliminating the need for a separate adapter component part.

Figure 5:
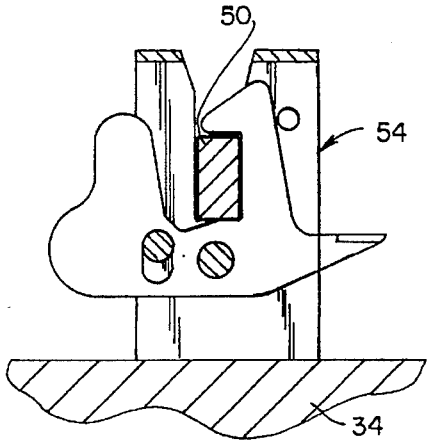
FIG. 5 is a partial sectioned elevational view of a conventional foot latch assembly provided in the installations of FIGS. 1 through 3 and taken along the line 5—5 of FIG. 2.

FIG. 5 schematically illustrates a conventional foot latch assembly (54) in elevation, and shows the engagement of yoke assembly extension (50) with that device when the improved crank assembly (36) is secured in its FIG. 3 extreme operating position.

Normally the principal components of the improved switch stand and its crank assembly elements are made of various forged steels. However, other materials, component shapes, and component preferred sizes may be utilized in the practice of this invention.

Since certain changes may be made in the above-described system and apparatus not departing from the scope of the invention herein and above, it is intended that all matter contained in the description or shown in the accompanying drawings shall be interpreted as illustrative and not in a limiting sense.

The herein disclosed invention is claimed as follows:

1. A manual railroad switch stand for changing railroad track switchpoint positions, comprising:

a switching input shaft that has a longitudinal axis and that is rotated throughout an operating angular range substantially less than 180 degrees to change track switchpoint positions;

a manual crank arm connected to said input shaft and having a longitudinal axis;

a latch yoke attached to said crank arm and having a pair of latch bars positioned distantly from and to each side of said crank arm longitudinal axis; and coupling means rigidly connecting said crank arm and said attached latch yoke with latch bars to said switch stand switching input shaft; and wherein each of said latch bars are positioned to engage and be stopped by a respective one of a pair of foot latches substantially diametrically positioned to opposite sides with respect to said switching input shaft longitudinal axis when said manual crank arm and connected switch stand switching input shaft are rotated through the input shaft operating angular range to accomplish a change in switch positions.

2. The manual railroad switch stand defined by claim 1 wherein said diametrically-opposed foot latches are positioned to be foot-operated to release said latch yoke latch bars from retention in their stopped positions.

3. The manual railroad switch stand defined by claim 1 and further comprised of a handle attached to said manual crank arm, said handle having hand-grasp offsets that are each positioned a substantial distance laterally from said manual crank arm longitudinal axis.

4. A railroad switch stand manual crank assembly comprising:

an elongate crank arm having longitudinal extremes and a longitudinal axis;

a hub connected to said crank arm at one of said crank arm longitudinal extremes;

a handle connected to said crank arm at the other of said crank arm longitudinal extremes; and a latch yoke connected to said crank arm at a position intermediate said hub and said handle and having a pair of latch bars each positioned distantly from and transversely with respect to said crank arm longitudinal axis, said latch bars being positioned so as to form an angle of approximately 30 degrees between said crank arm longitudinal axis and a line extending from said hub to one of said latch bars.

5. The railroad switch stand manual crank assembly defined by claim 4 wherein said hub is formed separately from said crank arm and is adapted to rigidly couple said crank arm to a railroad switch stand switching input shaft in bi-directional torque transmitting relation.

* * * * *